US008212733B2

(12) United States Patent
Jan et al.

(10) Patent No.: US 8,212,733 B2
(45) **Date of Patent: *Jul. 3, 2012**

(54) SIGNAL RECEIVER AND FREQUENCY DOWN CONVERTER THEREOF

(75) Inventors: Cheng Geng Jan, Taipei County (TW); Chieh Sheng Hsu, Taipei County (TW); San Yi Kuo, Taipei County (TW); Tzyy Shinn Huang, Taipei County (TW)

(73) Assignee: Wistron NeWeb Corp., Hsinchu (TW)

( * ) Notice: Subject to any disclaimer, the term of this patent is extended or adjusted under 35 U.S.C. 154(b) by 817 days.

This patent is subject to a terminal disclaimer.

(21) Appl. No.: 12/273,431

(22) Filed: Nov. 18, 2008

(65) Prior Publication Data

US 2009/0066444 A1 Mar. 12, 2009

Related U.S. Application Data

(62) Division of application No. 11/007,433, filed on Dec. 8, 2004, now Pat. No. 7,468,707.

(30) Foreign Application Priority Data

Jan. 6, 2004 (TW) ..... 93100205 A

(51) Int. Cl.
*H01Q 13/00* (2006.01)

(52) U.S. Cl. ..... 343/772; 343/786; 343/762; 343/771; 343/776

(58) Field of Classification Search ..... None
See application file for complete search history.

(56) References Cited

U.S. PATENT DOCUMENTS

| | | | | |
|---|---|---|---|---|
| 5,398,035 | A * | 3/1995 | Densmore et al. | 343/713 |
| 6,031,507 | A * | 2/2000 | Aoki | 343/840 |
| 6,271,799 | B1 * | 8/2001 | Rief et al. | 343/776 |
| 6,621,375 | B2 * | 9/2003 | Vezmar et al. | 333/125 |
| 6,677,911 | B2 * | 1/2004 | Moheb | 343/786 |
| 6,861,999 | B2 * | 3/2005 | Suga | 343/786 |
| 6,970,138 | B2 * | 11/2005 | McCandless et al. | 343/756 |
| 7,239,285 | B2 * | 7/2007 | Cook | 343/786 |
| 7,468,707 | B2 * | 12/2008 | Jan et al. | 343/772 |
| 2003/0058183 | A1 * | 3/2003 | Nakagawa et al. | 343/786 |
| 2003/0142027 | A1 * | 7/2003 | Moheb | 343/772 |

* cited by examiner

*Primary Examiner* — Trinh Dinh

(57) ABSTRACT

A frequency down converter. A plate body of the frequency down converter includes a main surface. A first wave guide includes a first section and a second section connected to the first section. The first section is connected to the main surface and extends parallel thereto. The second section extends perpendicular to the main surface. A second wave guide includes a third section and a fourth section connected to the third section. The third section is connected to the main surface and extends parallel thereto. The fourth section extends perpendicular to the main surface.

18 Claims, 7 Drawing Sheets

SIGNAL RECEIVER AND FREQUENCY DOWN CONVERTER THEREOF

This application is a division of U.S. application Ser. No. 11/007,433, filed Dec. 8, 2004, now U.S. Pat. No. 7,468,707, which claims the benefit of priority under 35 U.S.C. 119 from TAIWAN application No. 93100205 filed on Jan. 6, 2004, the entire disclosures of which are hereby incorporated by references.

BACKGROUND

The present invention relates to a frequency down converter, and in particular to a frequency down converter that receives signals from different satellites.

FIG. 1 shows a conventional signal receiver comprising a reflective surface 110 and frequency down converter 120, comprising wave guides 121, 122 and 123 receiving signals from satellites 131, 132 and 133.

FIG. 2*a* is a conventional signal receiver receiving signals in a normal condition. Signals are emitted from satellites 131, 132 and 133, reflected by the reflective surface 110, and separately received by the wave guides 121, 122 and 123.

However, as shown in FIG. 2*b*, different satellites move along different paths, such that distances between satellites 131, 132, and 133 are different from distances between satellites 141, 142, and 143. Thus, as shown in FIG. 2*c*, frequency down converter 120, designed to receive signals from satellites 131, 132, and 133, cannot receive signals from satellites 141, 142, and 143.

As shown in FIG. 3*a*, in a conventional frequency down converter, wave guides 121, 122, and 123 are straight. As shown in FIG. 3*b*, circuit board 150 disposed in frequency down converter 120 comprises signal receiving ports 151, 152, and 153 corresponding to wave guides 121, 122, and 123 to receive signals. If the circuit board 150 is to receive signals from satellites along other paths, the distances between the receiving ports 151, 152, and 153 must be changed, requiring layout of the circuit board 150 to be redesigned, increasing costs and time.

SUMMARY

The present invention comprises a body, a first wave guide and a second wave guide. The body comprises a main surface. The first wave guide comprises a first section and a second section. The first section is connected to the main surface with an end and extends parallel thereto. The second section is connected to the first section and extends perpendicular to the main surface. The second wave guide comprises a third section and a fourth section. The third section is connected to the main surface with an end and extends parallel thereto. The fourth section is connected to the third section and extends perpendicular to the main surface.

Lengths of the first and the third sections vary with requirements, defining the distance between the second and the fourth sections. Thus, the frequency down converter can receive signals from satellites along any path without redesigning the circuit board thereof.

DESCRIPTION OF THE DRAWINGS

The present invention can be more fully understood by reading the subsequent detailed description and examples with references made to the accompanying drawings, wherein.

DETAILED DESCRIPTION

First Embodiment

Figure 1:
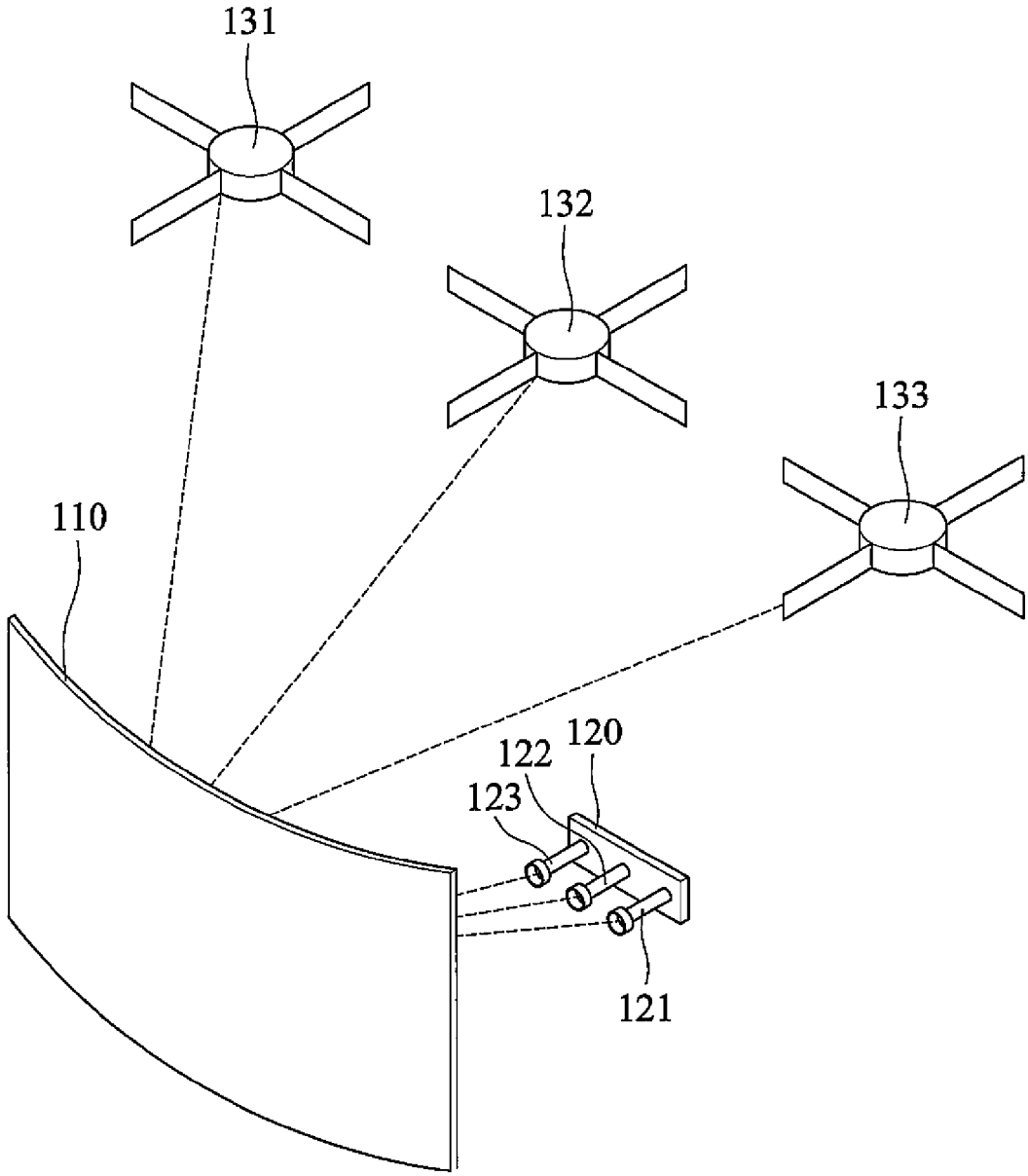
FIG. 1 ( RELATED ART )
FIG. 1 is a schematic view of a conventional signal receiver.
Figure 2A:
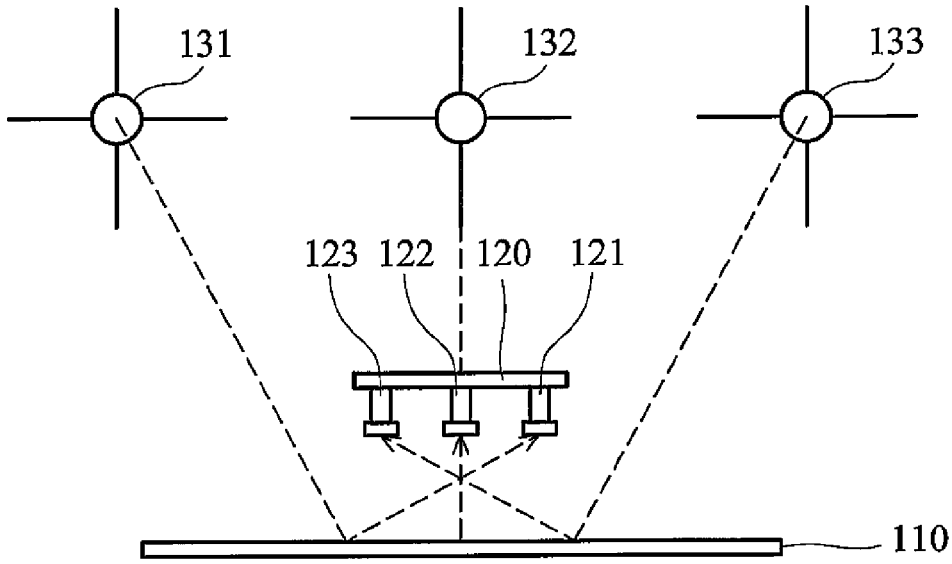
FIG. 2a ( RELATED ART )
FIG. 2*a* is a schematic view of the conventional signal receiver receiving satellite signals.
Figure 2B:
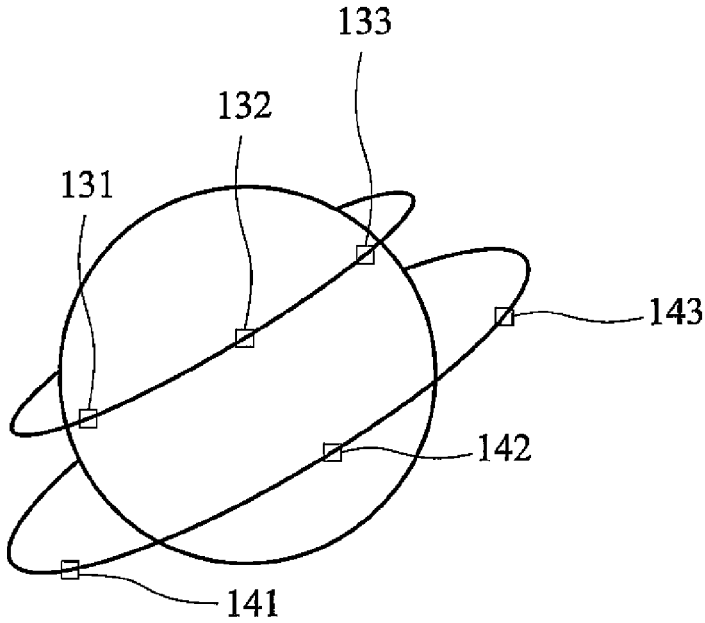
FIG. 2b ( RELATED ART )
FIG. 2*b* shows satellites moving along different paths.
Figure 2C:
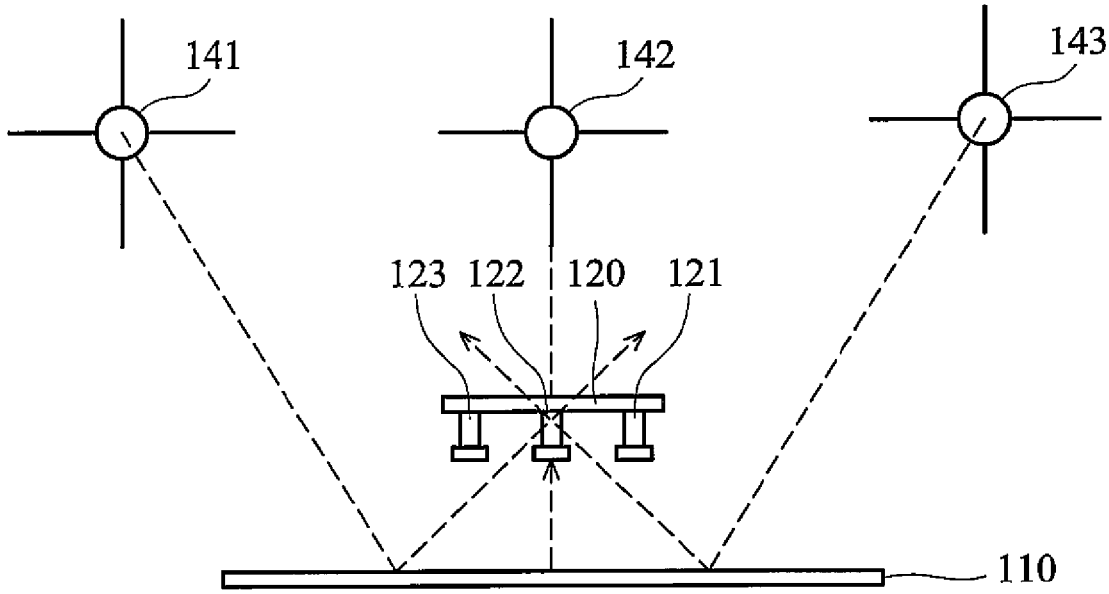
FIG. 2c ( RELATED ART )
FIG. 2*c* shows the conventional signal receiver receiving signals from satellites along other paths.
Figure 3A:
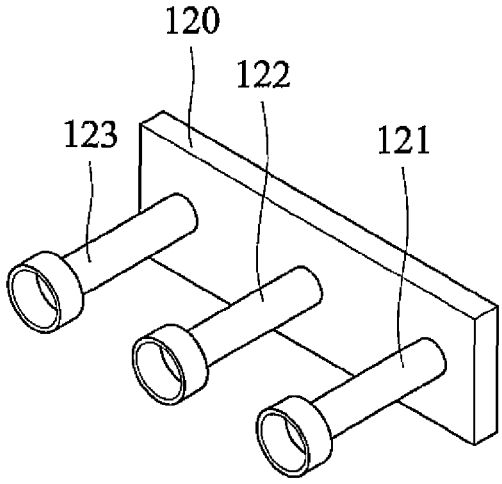
FIG. 3a ( RELATED ART )
FIG. 3*a* shows a conventional frequency down converter.
Figure 3B:
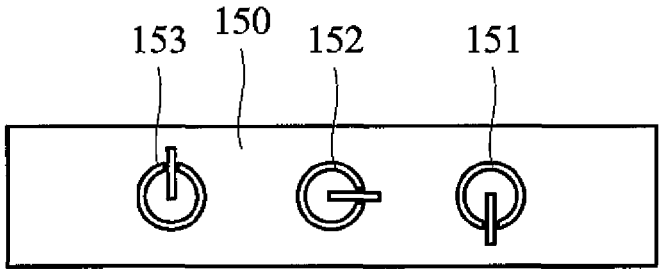
FIG. 3b ( RELATED ART )
FIG. 3*b* shows a conventional circuit board.
Figure 3C:
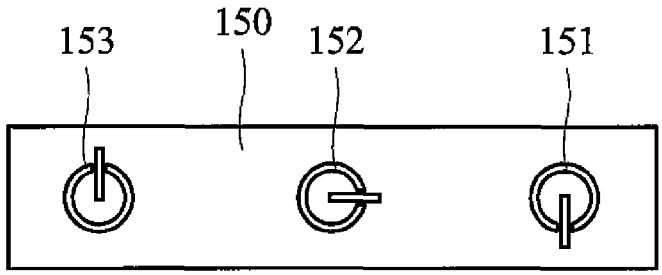
FIG. 3c ( RELATED ART )
FIG. 3*c* shows another conventional circuit board.
Figure 4A:
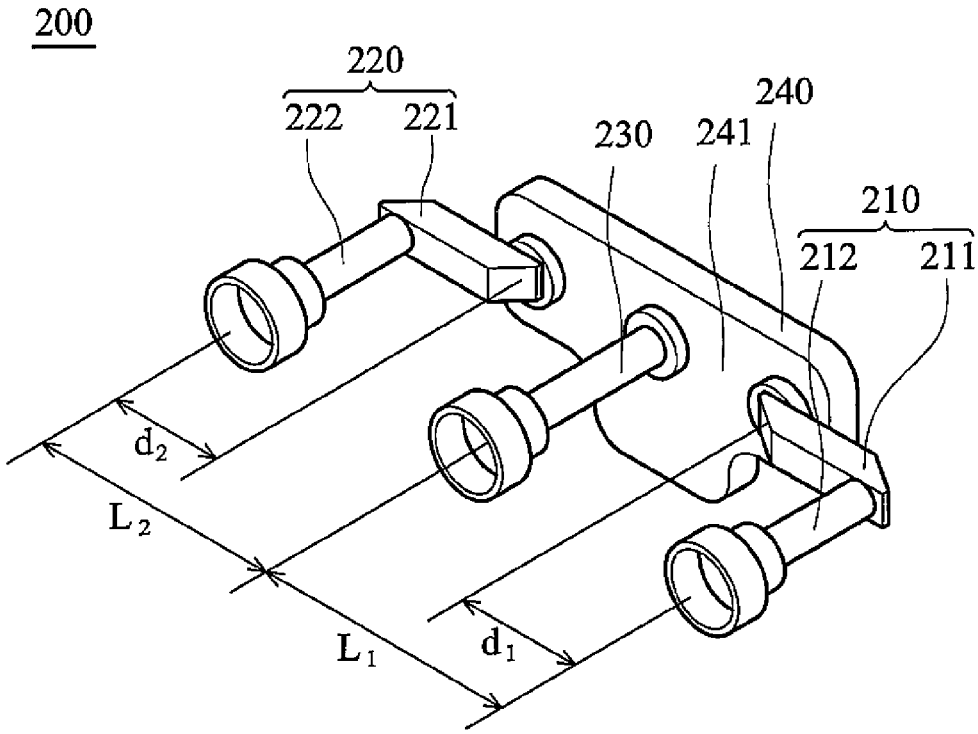
FIG. 4*a* shows a frequency down converter of a first embodiment of the present invention.
Figure 4B:
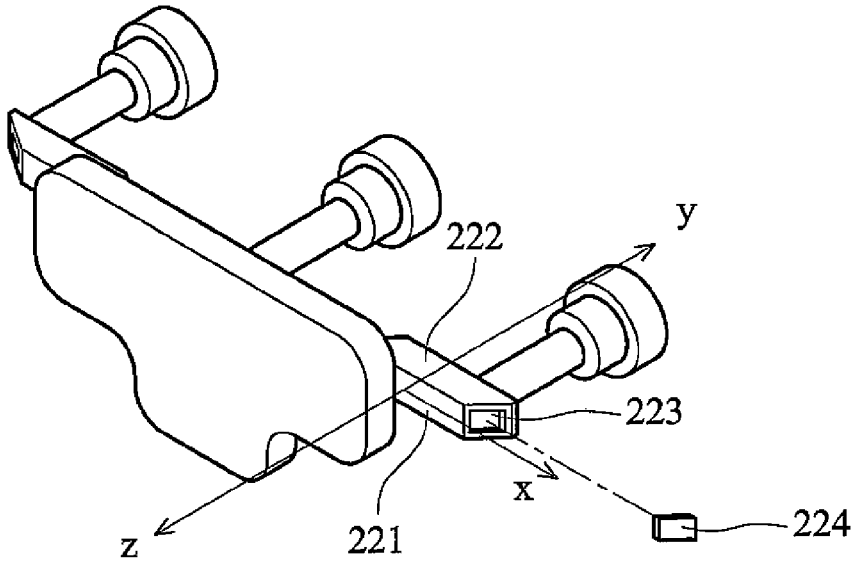
FIG. 4*b* shows openings of a first and a third sections of the frequency down converter.

FIG. 4*a* shows a frequency down converter of a first embodiment of the invention. The frequency down converter 200 comprises a flat body 240, a first wave guide 210, a second wave guide 220 and a third wave guide 230. The first wave guide 210 comprises a first section 211 and a second section 212. An end of the first section 211 is connected to a main surface 241 of the body 240, and another end of the first section 211 is connected to the second section 212. The first section is parallel to the main surface 241, and the second section 212 is perpendicular thereto. The second wave guide 220 comprises a third section 221 and a fourth section 222. An end of the third section 221 is connected to the main surface 241, and another end of the third section 221 is connected to the fourth section 222. The third section 221 is parallel to the main surface 241, and the fourth section 222 is perpendicular thereto. The third wave guide 230 is disposed on the main surface 241 between the first wave guide 210 and the second wave guide 220. The third wave guide 230 is perpendicular to the main surface 241.

A length d1 of the first section 211 and a length d2 of the third section 221 can be varied as required by manufacture to provide a distance L1 between the second section 212 and the third wave guide 230 and a distance L2 between the fourth section 222 and the third wave guide 230. Thus, the frequency down converter 200 can receive signals from satellites along any path without redesigning the circuit board thereof.

During manufacture, molding (not shown) of the first wave guide 210 and the second wave guide 220 requires formation of a second opening 223 at an end of the third section 221 close to the fourth section 222, enabling the mold to be disassembled along X direction. The first section 211 has a first opening 213 (not shown) formed during fabrication at an end of the first section 211 close to the second section 212, enabling the mold to be disassembled along −X direction. After disassembling, a second cover 224 is disposed on the second opening 223 to prevent signal leakage therefrom. Similarly, a first cover 214 (now shown) is disposed on the first opening 213 to prevent signal leakage therefrom.

If the first section 211, the second section 212, the third section 221 and the fourth section 222 are cylindrical. The conical portions (not shown) are formed on the mold (not shown) corresponding to a connection portion between the first section 211 and the second section 212 and a connection portion between the third section 221 and a fourth section 222. The conical portions (not shown) are weak and unable to endure high temperature. The first section 211 and the third section 221 form the cube-shaped-like design, matching with cylindrical design of the second section 212 and fourth section 222 to obviate the formation of the conical portions on the mold.

Impedance matchings (not shown) are disposed on the connection portion between the first section 211 and the second section 212 and the connection portion between the third section 221 and the fourth section 222. Thus, signals are transmitted from the cylindrical tubes (the second section 212 and the fourth section 222) to the cube-shaped tubes (the first section 211 and the third section 221) without disturbance.

Figure 4C:
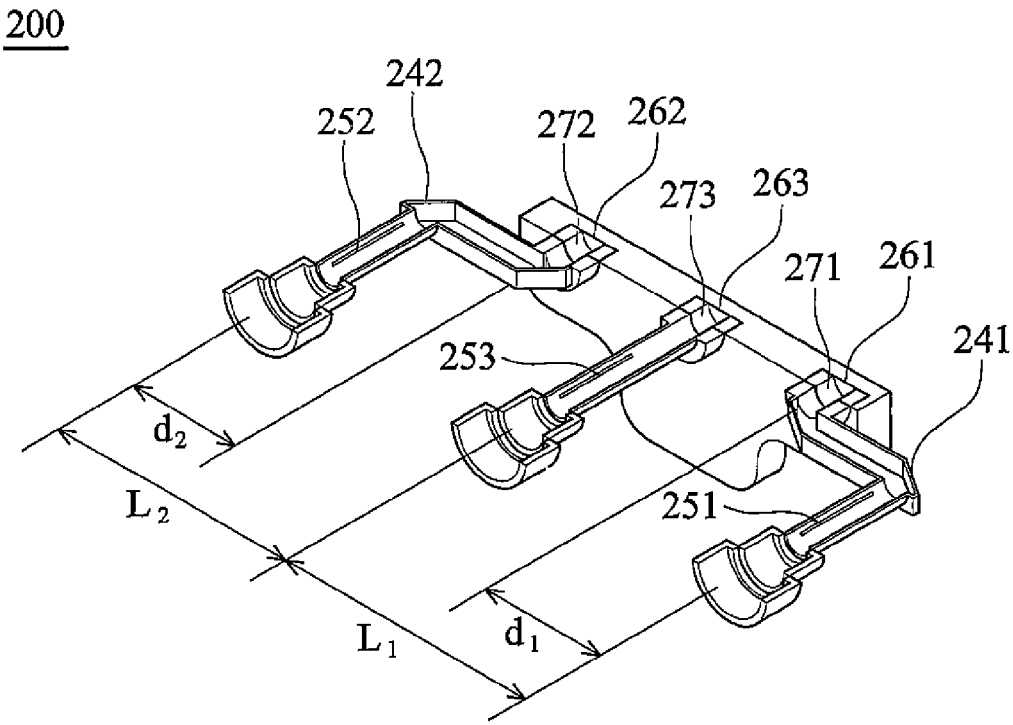
FIG. 4*c* is a section view of the frequency down converter of the embodiments of the invention.

As shown in FIG. 4*c*, a first slot 251, a second slot 252 and a third slot 253 are formed in the second section 212, the fourth section 222 and the third wave guide 230 respectively. Removable polarizers (not shown) can be installed in the first slot 251, the second slot 252 and the third slot 253 to produce circular polarized waves. The first wave guide 210 connects to a first connection tube 271 disposed in the body 240. The first connection tube 271 has an opening 261. The second wave guide 220 connects to a second connection tube 272 disposed in the body 240. The second connection tube 272 has an opening 262. The third wave guide 230 connects to a third connection tube 273 disposed in the body 240. The third connection tube 273 has an opening 263.

Figure 4D:
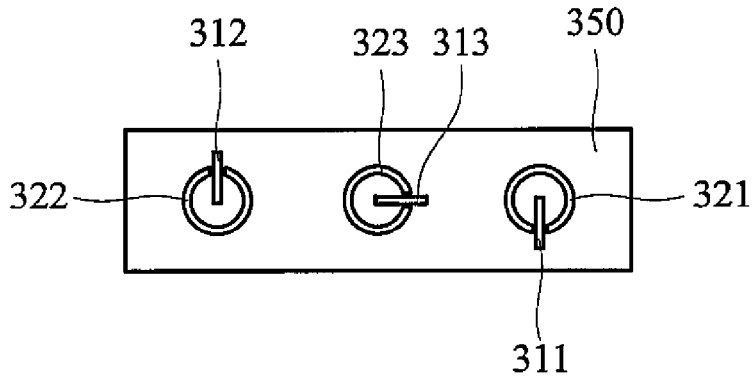
FIG. 4*d* shows a circuit board in the frequency down converter of the embodiments of the invention.

As shown in FIG. 4*d*, the opening 261 contacts a signal receiving port 321 on a circuit board 350 of the frequency down converter 200. The opening 262 contacts a signal receiving port 322 and the opening 263 contacts a signal receiving port 323. Probes 311, 312, and 313 receive signals. The probes can receive horizontal or vertical polarized signals.

A length d1 of the first section 211 and a length d2 of the third section 221 can be varied as required during manufacture to provide a distance L1 (first distance) between the second section 212 and the third wave guide 230 and a distance L2 (second distance) between the fourth section 222 and the third wave guide 230. Thus, the frequency down converter 200 can receive signals from satellites along any path without redesigning the circuit board thereof. Thus, manufacture costs and time are reduced.

Second Embodiment

Figure 5A:
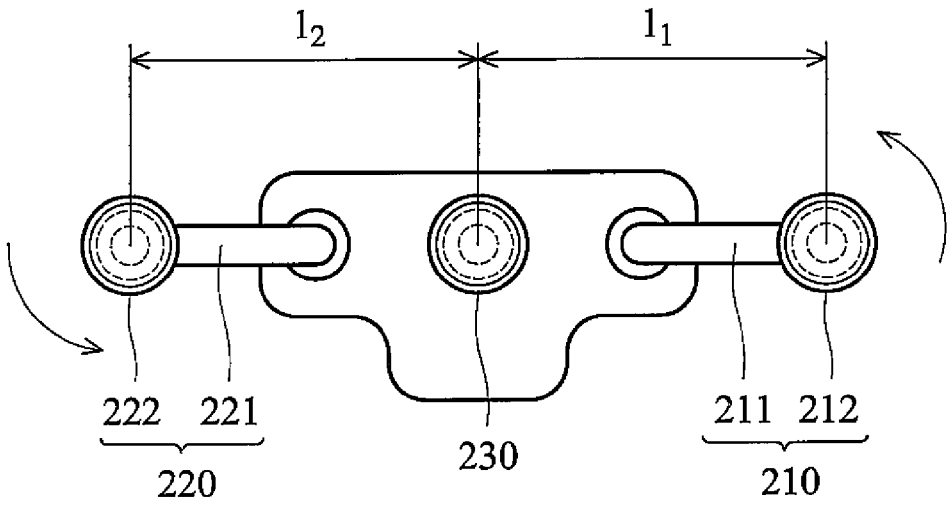
FIG. 5*a* shows a frequency down converter of a second embodiment of the invention.
Figure 5B:
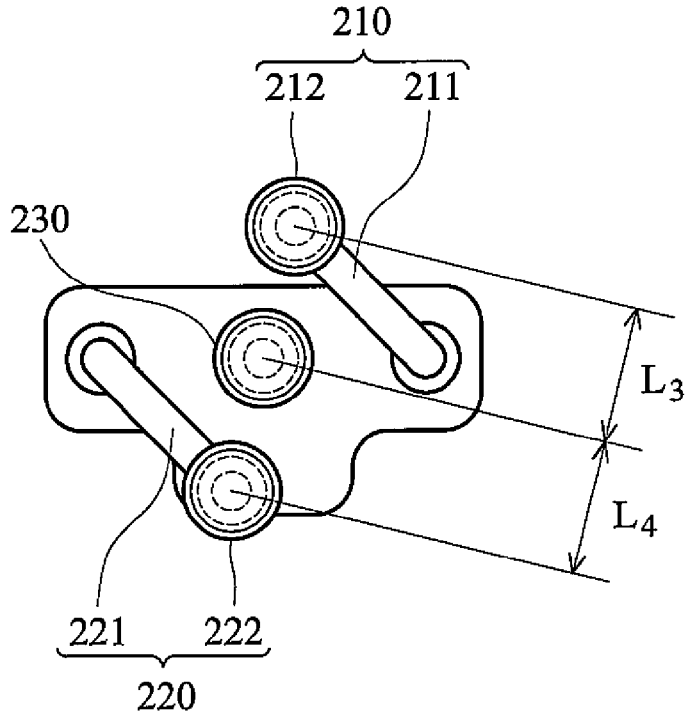
FIG. 5*b* shows wave guides of the frequency down converter rotated.

FIG. 5*a* shows a second embodiment of the invention. In this embodiment, the first section 211 and the third section 221 are rotatably disposed on the body 240. As shown in FIG. 5*b*, after rotation, a distance L3 is formed between the first wave guide 210 and the third wave guide 230, and a distance L4 is formed between the second wave guide 220 and the third wave guide 230. Thus, signal reception is improved.

This embodiment can also be applied on frequency down converters with two or four wave guides. For example, in FIG. 4*a*, the second wave guide 220 or the third wave guide 230 can be removed (two wave guides), or an additional wave guide 230 can be disposed between the first wave guide 210 and the second wave guide 220 (four wave guides).

While the invention has been described by way of example and in terms of the preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A frequency down converter, comprising:

a body comprising a main surface;

a first wave guide comprising a first section and a second section with a free end, the first section connected to the main surface, the second section connected to the first section, the longitudinal direction of the second section perpendicular to the main surface, wherein the first section comprises a first opening and a first cover, the first opening formed on the first section near the second section, and the first cover disposed at and completely covering the first opening; and a second wave guide comprising a third section and a fourth section with a free end, the third section connected to the main surface, the fourth section connected to the third section, the longitudinal direction of the fourth section perpendicular to the main surface.

2. The frequency down converter as claimed in claim 1, wherein the second section comprises a first slot disposed therein and extending parallel thereto.

3. The frequency down converter as claimed in claim 1, wherein the first section is cube-shaped, and the second section is cylindrical.

4. The frequency down converter as claimed in claim 1, wherein the first section is rotatably connected to the main surface, and the first section rotates around an axis perpendicular to the main surface.

5. The frequency down converter as claimed in claim 1, wherein the fourth section comprises a first slot disposed therein and extending parallel thereto.

6. The frequency down converter as claimed in claim 1, wherein the third section is cube-shaped, and the fourth section is cylindrical.

7. The frequency down converter as claimed in claim 1, wherein the third section comprises a first opening and a first cover, the first opening formed on the third section near the fourth section, and the first cover disposed at and completely covering the first opening.

8. The frequency down converter as claimed in claim 1, wherein the third section is rotatably connected to the main surface, and the third section rotates around an axis perpendicular to the main surface.

9. The frequency down converter as claimed in claim 1, further comprising a third wave guide, disposed on the main surface between the first wave guide and the second wave guide.

10. A signal receiver, comprising:

a reflective surface; and a frequency down converter receiving signals reflected from the reflective surface, comprising:

a body comprising a main surface;

a first wave guide comprising a first section and a second section with a free end, the first section connected to the main surface, the second section connected to the first section, the longitudinal direction of the second section perpendicular to the main surface, wherein the first section comprises a first opening and a first cover, the first opening formed on the first section near the second section, and the first cover disposed at and completely covering the first opening; and a second wave guide comprising a third section and a fourth section with a free end, the third section connected to the main surface, the fourth section connected to the third section, the longitudinal direction of the fourth section perpendicular to the main surface.

11. The signal receiver as claimed in claim 10, wherein the second section comprises a first slot disposed therein and extending parallel thereto.

12. The signal receiver as claimed in claim 10, wherein the first section is cube-shaped, and the second section is cylindrical.

13. The signal receiver as claimed in claim 10, wherein the first section is rotatably connected to the main surface, and the first section rotates around an axis perpendicular to the main surface.

14. The signal receiver as claimed in claim 10, wherein the fourth section comprises a first slot disposed therein and extending parallel thereto.

15. The signal receiver as claimed in claim 10, wherein the third section is cube-shaped, and the fourth section is cylindrical.

16. The signal receiver as claimed in claim 10, wherein the third section comprises a first opening and a first cover, the first opening formed on the third section near the fourth section, and the first cover disposed at and completely covering the first opening.

17. The signal receiver as claimed in claim 10, wherein the third section is rotatably connected to the main surface, and the third section rotates around an axis perpendicular to the main surface.

18. The signal receiver as claimed in claim 10, further comprising a third wave guide, disposed on the main surface between the first wave guide and the second wave guide.

* * * * *